US010603809B2

(12) United States Patent
Nabity et al.

(10) Patent No.: US 10,603,809 B2
(45) Date of Patent: Mar. 31, 2020

(54) DIE CUT WITH COMMON BLADES

(75) Inventors: Stephen Nabity, Elkhorn, NE (US); Andrea Ronning, Ponca, NE (US)

(73) Assignee: TEK INDUSTRIES, INC., Fremont, NE (US)

( * ) Notice: Subject to any disclaimer, the term of this patent is extended or adjusted under 35 U.S.C. 154(b) by 905 days.

(21) Appl. No.: 13/498,357

(22) PCT Filed: Sep. 28, 2010

(86) PCT No.: PCT/US2010/050470

§ 371 (c)(1),
(2), (4) Date: Jul. 18, 2012

(87) PCT Pub. No.: WO2011/038377

PCT Pub. Date: Mar. 31, 2011

(65) Prior Publication Data

US 2012/0272802 A1 Nov. 1, 2012

Related U.S. Application Data

(60) Provisional application No. 61/246,358, filed on Sep. 28, 2009.

(51) Int. Cl.

| | |
|---|---|
| ***B26F 1/44*** | (2006.01) |
| *B26D 7/22* | (2006.01) |
| *B26F 1/42* | (2006.01) |

(52) U.S. Cl.

CPC ..... *B26F 1/44* (2013.01); *B26D 7/22* (2013.01); *B26F 1/42* (2013.01); *B26F 2001/4436* (2013.01); *B26F 2001/4463* (2013.01); *Y10T 83/06* (2015.04); *Y10T 83/9304* (2015.04)

(58) Field of Classification Search

CPC . B26D 7/1818; B26D 7/22; B26F 1/42; B26F 2001/4463; B26F 1/44; B26F 1/4436; Y10T 83/9304; Y10T 83/06

USPC ..... 83/128, 130, 620, 55

See application file for complete search history.

(56) References Cited

U.S. PATENT DOCUMENTS

| | | | | |
|---|---|---|---|---|
| 1,408,537 A * | 3/1922 | Shaw | B26F 1/44 83/696 |
| 3,256,764 A * | 6/1966 | Hardy | 83/690 |
| 3,263,539 A * | 8/1966 | Daniel | B26D 1/095 83/140 |
| 3,464,293 A * | 9/1969 | Schnorr | B26F 1/44 122/406.1 |

(Continued)

*Primary Examiner* — Andrea L Wellington
*Assistant Examiner* — Samuel A Davies
(74) *Attorney, Agent, or Firm* — Milligan PC LLO

(57) ABSTRACT

The present invention is generally directed to a die cut assembly for a roller die cutting machine having a base member, a cutting rule, and a compressible top layer. Base member is generally a rectangular shape, having a length, width and thickness. A cutting rule including a cutting edge is formed into a pattern containing a plurality of geometric shapes. The pattern containing geometric shapes is formed to include each geometric shape sharing a common point when the shape allows it. Cutting rule is generally coupled to the base member at a skew wherein no side of the pattern is transverse to the length of the base member. The compressible top layer is coupled to the base member. Generally, cutting rule nests in compressible top layer and compressible top layer extends beyond the cutting edge of the cutting rule.

1 Claim, 6 Drawing Sheets

(56) References Cited

U.S. PATENT DOCUMENTS

| | | | | | |
|---|---|---|---|---|---|
| 3,611,851 | A * | 10/1971 | Lingofelt | B28B 11/14 | 83/32 |
| 3,766,854 | A * | 10/1973 | Scarlet | B41F 17/00 | 101/115 |
| 3,826,170 | A * | 7/1974 | Jones | B26D 7/2614 | 76/107.8 |
| 4,480,507 | A * | 11/1984 | Boogers | A24C 1/04 | 76/107.8 |
| 6,408,729 | B1 * | 6/2002 | Johnson | 83/697 | |
| 7,568,295 | B1 * | 8/2009 | Strain | D05B 97/12 | 33/1 B |
| 2007/0199466 | A1 * | 8/2007 | Franz | D06P 5/30 | 101/485 |
| 2007/0220769 | A1 * | 9/2007 | Oehlke | D05B 97/12 | 33/563 |

* cited by examiner

DIE CUT WITH COMMON BLADES

CROSS-REFERENCE TO RELATED APPLICATIONS

This application is being filed on 28 Sep. 2010 as a PCT International Patent application and claims priority to U.S. Provisional Application Serial No. 61/246,358 filed on Sep. 28, 2009, titled DIE CUT WITH COMMON BLADES, which is incorporated by reference herein in its entirety.

BACKGROUND OF THE INVENTION

Die cutting is an established form of quickly and accurately cutting shapes from sheet materials. Die cutting has been used extensively in industrial applications to cut boxes, cartons, shoe soles, clothing and many other components of manufactured items. These large industrial dies are usually utilized with large hydraulic presses or mechanized rollers. The dies are often multiple feet in dimension, of medium to heavy weight and have exposed cutting edges. These industrial dies are used almost exclusively in a controlled industrial environment and handled and maintained by trained personnel. Mass production necessarily limits the variety of shapes, sizes and materials produced by industrial die cutting machines. Additionally, mass production does not facilitate enthusiastic crafts people obtaining particular cut-out shapes and sizes in the pattern, color or material that they seek out.

Many smaller die cutting machines have been developed so that crafts-people can create the exact shape in the exact size, pattern and material as desired in a more economical manner. One example of such a die cutting machine is described in U.S. Pat. No. 5,647,260. These die cutting machines, which are often used in schools, businesses and homes, are currently available in the market place. Most of these smaller die cutting machines are generally a roller-type machine wherein rollers provide the compression necessary to force a die to cut the sheet material into the geometric cut-out shapes. Desirable features of die cuts used with these die cutting machines are the ability to accurately and effectively cut the sheet material, the ability to be safe for individuals to handle and transport, and a long usage life while requiring minimum maintenance by the individual user.

A need exists to provide a die cut for use in connection with roller die cutting machines that has the desired qualities of accurately and effectively cutting the sheet material, being safe for individuals to handle and transport, and will be able to be used over a long usage life requiring minimum maintenance by the individual user.

SUMMARY OF THE INVENTION

The present invention is generally directed to a die cut assembly for a roller die cutting machine having a base member, a cutting rule, and a compressible top layer. The base member is generally rectangular in shape, having a length, width and thickness. A cutting rule or blade including a cutting edge is formed into a pattern containing a plurality of geometric shapes. The pattern containing the geometric shapes is configured such that the geometric shapes share a common rule or blade when the geometric shape allows it. The cutting rule is generally joined to the base member in a skewed or angled orientation whereby no side or edge of the pattern is transverse to the length of the base member. The compressible top layer is coupled to the base member.

Generally, the cutting rule nests in the compressible top layer and the top face of the compressible top layer extends beyond the cutting edge of the cutting rule in a direction away from the base member. One embodiment includes the cutting rule formed in a pattern including multiple right triangles. All of the triangles share either a common hypotenuse or a base side and some of the triangles share both. Another embodiment includes the cutting rule formed into multiple squares wherein the squares share at least one common side.

An alternative embodiment of the present invention includes a transparent base member. The present invention also includes a method for cutting multiple pieces of fabric or paper using the claimed apparatus herein. Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
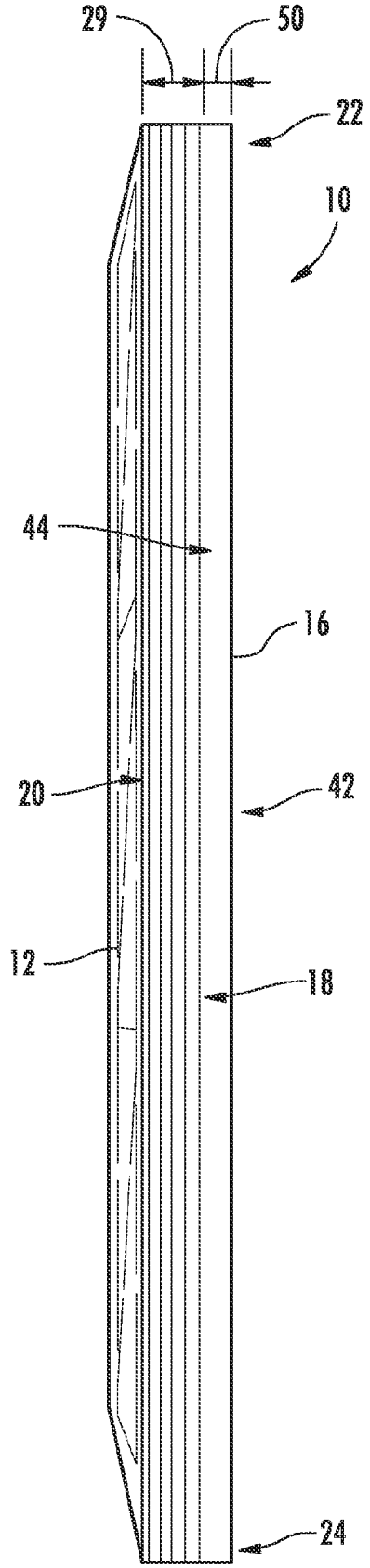
FIG. 1 is a side elevational view of a die cut assembly according to an embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawings.

Figure 2:
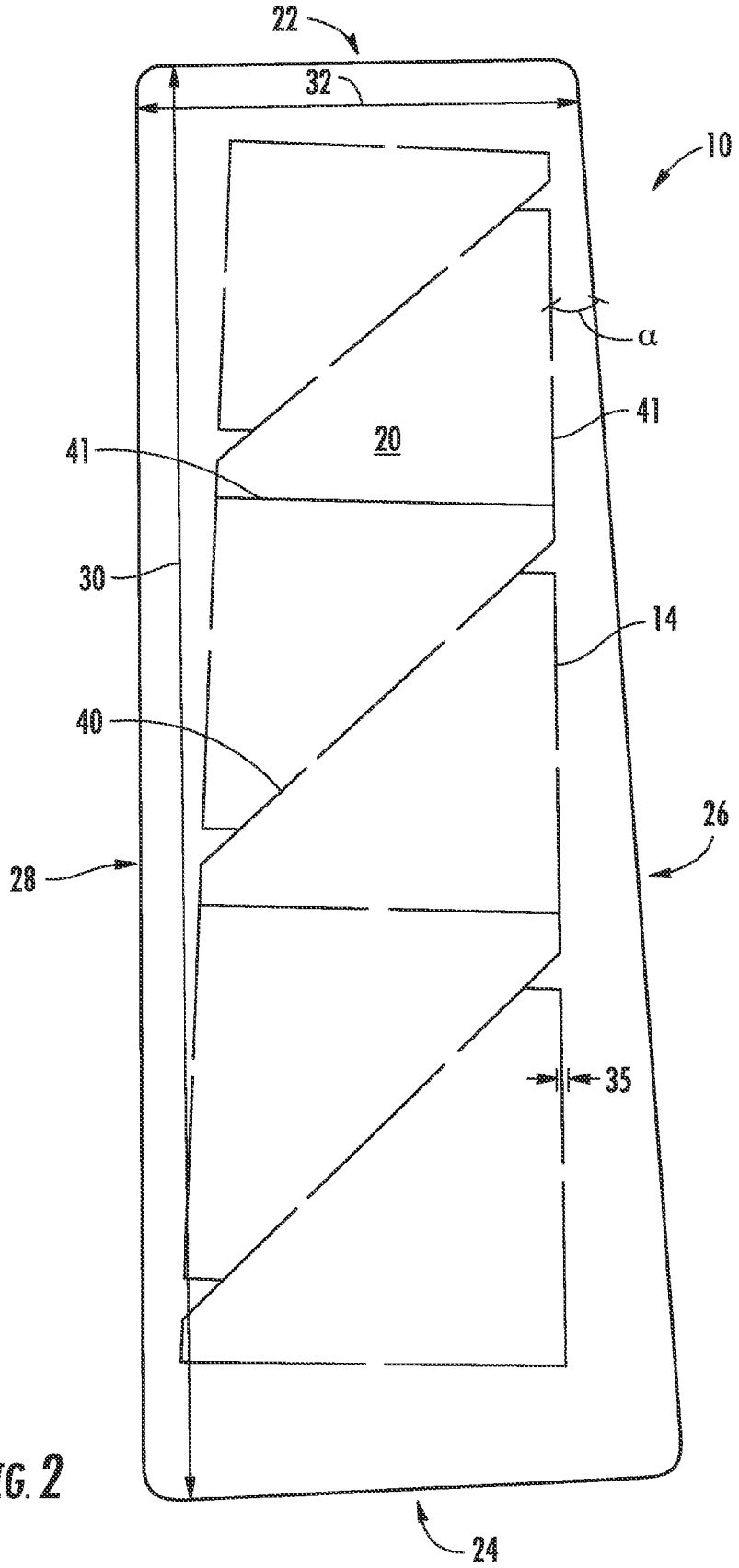
FIG. 2 is a bottom plan view of a die cut assembly according to an embodiment of the present invention.

Referring now to FIGS. 1 and 2, reference numeral 10 designates generally a die cut assembly used with a roller die cutting machine such as the one illustrated in U.S. Pat. No. 5,647,260 to cut sheet material (not shown) in to various predetermined shapes. As an alternative to a roller die cutting machine, the die cut assembly 10 may also be used in combination with any type of suitable press or other mechanism applying force or compression to the die cut assembly 10.

In general, the composition of the sheet material cut by die cut assembly 10 may include, but is not limited to fabric, paper, cardboard, plastic and the like. As shown, die cut assembly 10 is generally rectangular in shape and includes a base member 12, a cutting rule 14, and a compressible top layer 16. Base member 12 includes a top face 18, a bottom face 20, a first top end 22, a second bottom end 24, a left side 26, a right side 28, a thickness 29, a length 30 and a width 32 and lies in a generally horizontal plane. In general, the base member may be a rigid or semi-rigid material. Plywood or rigid plastic-like material is generally utilized for base member 12, but any suitable material known in the art may also be utilized. An alternative embodiment of base member 12 includes a sheet of clear material similar to Lexan®, Lucite® or Plexiglas so that an operator can visually position a graphic or pattern to be cut out by die cut assembly 10. The sheet of material, rather than being clear, may alternatively be colored or opaque. A further embodiment of the die cut assembly 10 may also include a protective plastic covering which may fit over the top of the die cut assembly 10.

Figure 3:
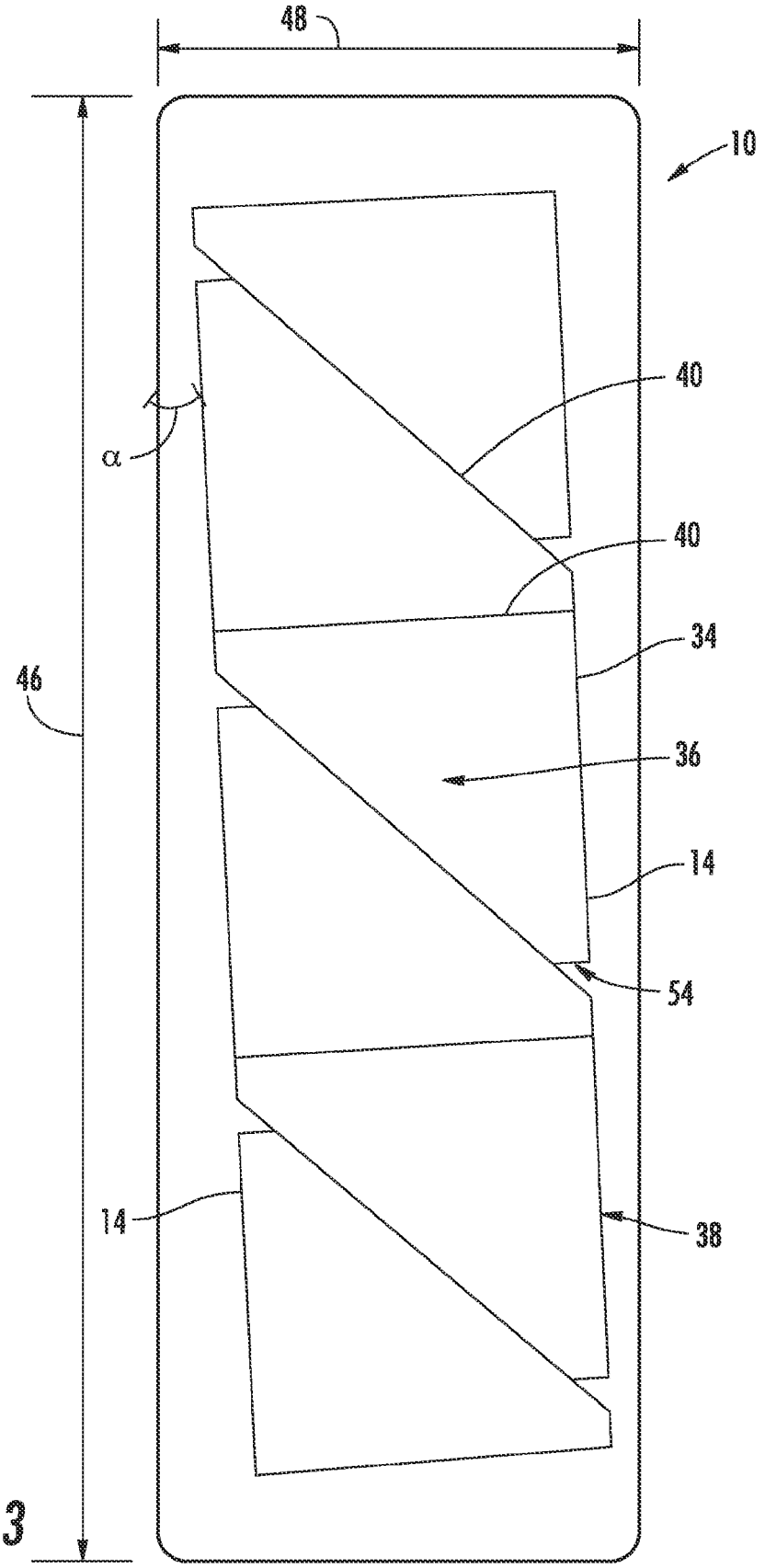
FIG. 3 is a top plan view of a die cut assembly according to an embodiment of the present invention.

Referring now to FIGS. 2 and 3, cutting rule 14 including a cutting edge 34, is formed into a pattern 36, and coupled to a position 38 on base member 12 wherein cutting rule 14 lies in a generally vertical plane with cutting edge extending about ⅛ to ½ inch away from top face of base member 12. Pattern 36 generally comprises common geometric shapes of similar or different sizes that return sheet material cut-outs 52 desirable for quilting or other similar arts and crafts activities like scrapbooking or card making Pattern 36 generally includes multiple cutouts in one die assembly. Pattern 36 may include multiple cut-outs of the same shape and size or may include cut-outs 52 of a variety of shapes and/or sizes.

When pattern 36 includes geometric shapes with linear or complimentary sides, cutting rule 14 may be patterned such that two adjacent geometric shapes include one common side 40. Sharing common side 40 allows the die assembly to have a more efficient layout of pattern 36 resulting in reduced waste of sheet material and providing the ability to include a greater number of cut-out 52 shapes realized per a given area of the die cut assembly 10. Additionally, the sharing of common sides 40 allows adjacent shapes to share a common cutting rule 14, thereby reducing the need for multiple cutting rules 14. This can reduce costs and material required to produce die cut assembly 10. Further, pattern 36 is in a skewed or angled orientation on base member 12 such that no linear side included in pattern 36 is transverse to length 30 of base member 12. As illustrated in FIG. 2, pattern 36 is skewed with respect to base member 12 at an angle $\alpha$. Angle $\alpha$ can be between about 1° and 45°, or alternatively between about 3° and 10°. Angle $\alpha$ is generally shown in the figures, for exemplary purposes only, at about 5°. Having pattern 36 in a skewed or angled orientation allows the compression to be applied gradually and progressively over long, linear cuts and ensures the roller compression applies an adequate cutting force at each instance along cutting edge 34. Further, a skewed or angled orientation protects the cutting edge 34 from the compression force by isolating the force exerted on cutting edge 34 at isolated points along cutting edge 34. This prolongs the life and wear of cutting rule 14 and cutting edge 34.

Figure 4:
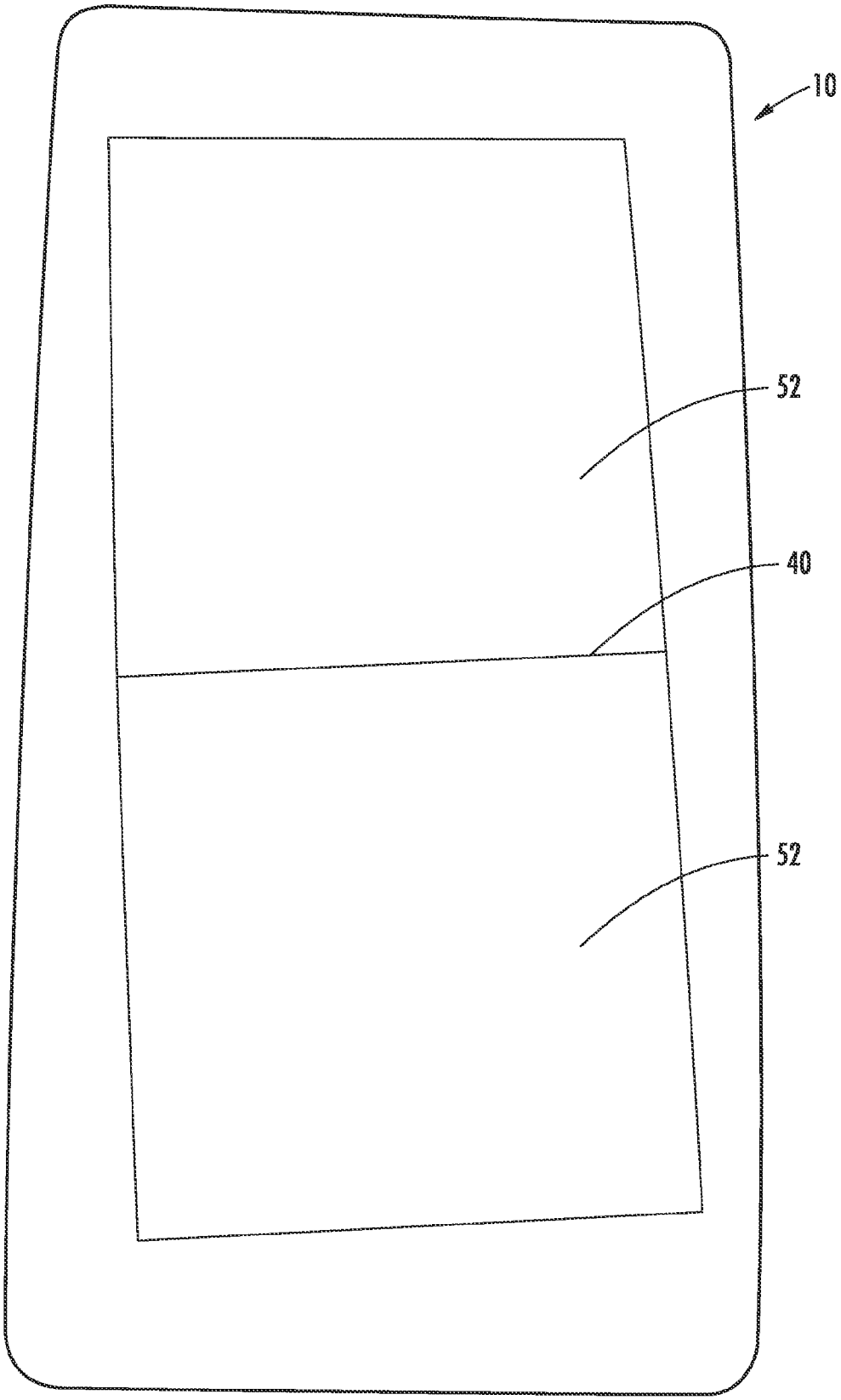
FIG. 4 is a top plan view of a die cut assembly according to an embodiment of the present invention.

FIGS. 2 and 3 also illustrate an embodiment of pattern 36 of die cut assembly 10 including polygons, namely multiple triangular shaped cut outs 52 on one die cut assembly 10. The triangles share a common side 40 with an adjacent triangle to realize efficient use of sheet material. Also, FIG. 3 illustrates an embodiment of pattern 36 that includes a dog-ear 54 at the corner of the triangle to ameliorate bunching in a quilt when connecting multiple triangular cut-outs to one common point using a standard ¼ inch seam allowance. The dog-ear 54 may be adjusted to accommodate other seam allowances as known in the art. Alternatively, FIG. 4 illustrates an embodiment including two square cut-outs 52 sharing a common side 40. Die cut assembly 10 may cut out any combination of shapes and sizes.

Figure 5:
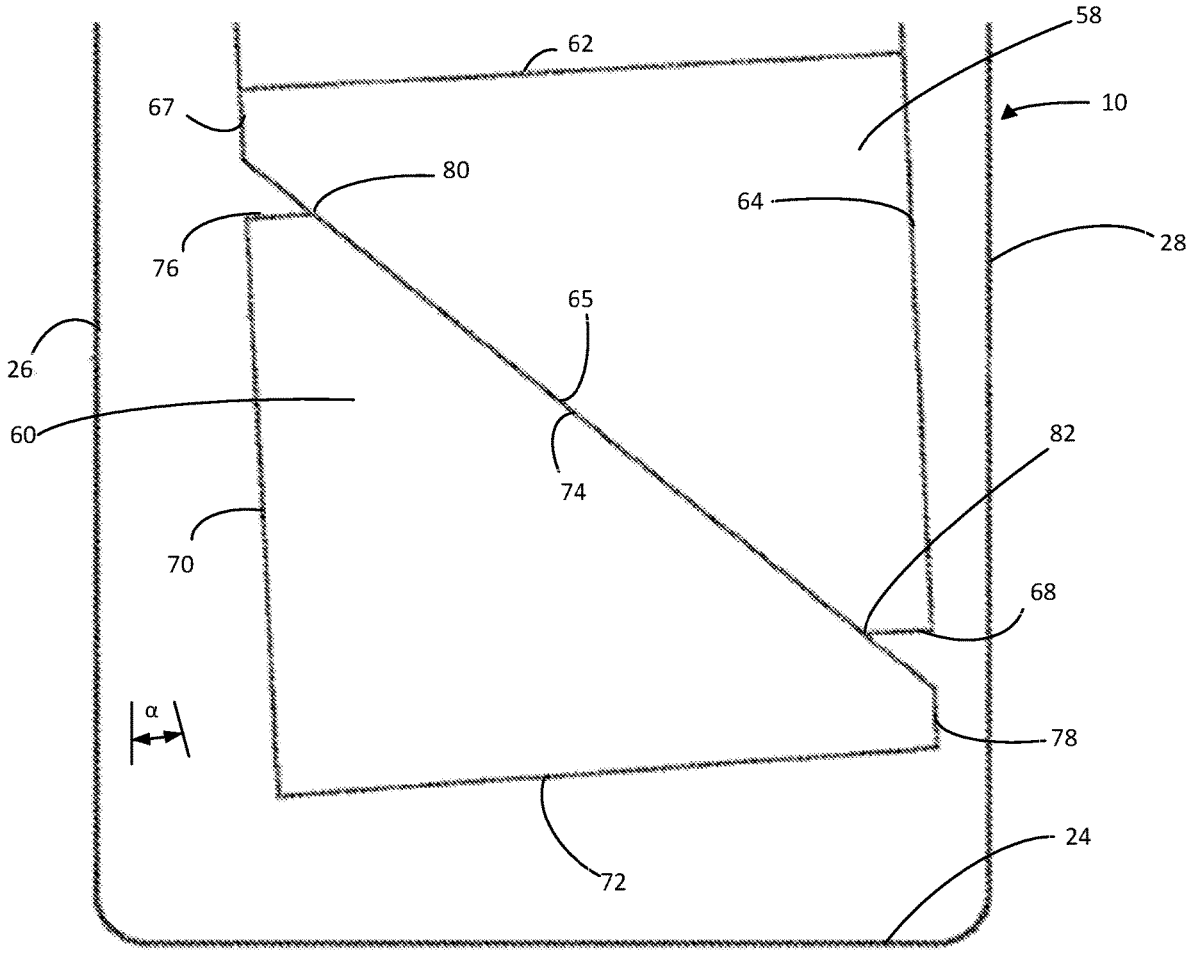
FIG. 5 is an enlarged view of a die cut assembly according to an embodiment of the present invention.

With further reference now to FIG. 5, an enlarged view of the die cut assembly 10 shown in FIGS. 2 and 3 is provide. In detail, the upper die 58 includes a first cutting edge 62, a second cutting edge 64, third cutting edge 65, a fourth cutting edge 67 and a fifth cutting edge 68. As shown, the first and second cutting edges 62, 64 are orthogonal to each other and the third cutting edge 65 is the longest cutting edge of the upper die. As further shown, the fourth cutting edge 67 is connected between the first cutting edge 62 and the third cutting edge 65. Likewise, the fifth cutting edge 68 is shown connected between the third cutting edge 65 and the second cutting edge 64. As shown, the fourth and fifth cutting edges 67, 68 may preferably be of equal size. As further shown, the fourth cutting edge 67 may be orthogonal to the fifth edge 68 and orthogonal to at least one of the first and second cutting edges 62, 64.

As further shown in FIG. 5, the lower die 60 may include a sixth cutting edge 70, a seventh cutting edge 72, an eighth cutting edge 74, a ninth cutting edge 76, and a tenth cutting edge 78. As shown, the sixth and seventh cutting edges 70, 72 are preferably aligned orthogonally to each other with the eighth cutting edge 74 being the longest edge of the lower die 60. As further shown, the ninth cutting edge 76 is connected between the sixth cutting edge 70 and the eighth cutting edge 74. Similarly, the tenth cutting edge 78 is connected between the eighth cutting edge 74 and the seventh cutting edge 72. Additionally, the ninth cutting edge 76 is preferably aligned orthogonal to the tenth cutting edge 78 and orthogonal to at least one of the sixth or seventh cutting edges 70, 72. As shown, the third cutting edge 65 of the upper die 58 and the eighth cutting edge 74 of the lower the 60 may preferably be the same cutting edge (i.e. common side 40 as discussed above).

As shown in FIG. 5, the upper and lower cutting dies 60, 62 of the present invention are preferably skewed/offset with respect to the base member 12 at an angle $\alpha$. As further discussed above, the angle $\alpha$ may be from about 1° to 45° or alternatively between about 3° and 10°. Accordingly, the first cutting edge 62, the fifth cutting edge 68, the seventh cutting edge 72 and the ninth cutting edge 76 may be offset by an angle $\alpha$ so that they are between 1°-45° and/or 3°-10° from being parallel with the first top end 22 and/or the second bottom end 24. Additionally, the second cutting edge 64, the fourth cutting edge 67, the sixth cutting edge 70 and the tenth cutting edge 78 may be offset by an angle $\alpha$ so that they are between 1°-45° and/or 3°-10° from being parallel to the left side 26 or right side 28 of the base member 12. Still further, the third cutting edge 65 and the eighth cutting edge 74 are preferably between 3°-10° from being at a 45° to the first top end 22 and the bottom end 24. The eighth edge 74 extends beyond the point of intersection 82 between the fifth edge 68 and the third edge 65. The third edge 65 extends beyond the point of intersection. 80 between the ninth edge 76 and the eighth edge 74.

Cutting rule 14 is generally made of a high strength metal strip having a blade width 35, but could be any material known in the art with the strength to perform shearing of fabric or paper and has the material properties allowing it to be formed into pattern 36. Blade width 35 of cutting rule 14 is generally in the range of 1/64 to 3/32 inches thick. In addition, cutting edge 34 is generally beveled to create a clean cut with little fraying. Cutting edge 34 may include a double beveled edge or alternatively, a single beveled edge. One embodiment includes a double beveled cutting rule 14 comprised of high strength steel to aid in holding a sharp cutting edge 34 thus allowing cutting rule 14 to have a long usage life with minimum maintenance. Die cut assembly 10 may include any combination of cutting rule material and/or bevels.

Die cut assembly 10 including base member 12 is generally sized for use in a roller die cutting machine (not shown), so die cut assembly's 10 size should correspond with use within a particular roller die cutting machine. Thus, die cut assembly 10 may also be sized such that it is easily portable to be consistent with die cut assembly's 10 use with a portable roller die cutting machine. The size of die cut assembly 10 generally corresponds with the dimensions of base member 12 and is set to accommodate the desired pattern 36 of cutting rule 14. Base member 12 is generally sized with a length 30 ranging from about 6 to 18 inches, width 32 ranging from about 4 to 12 inches, and thickness 29 in the range of about ¼ inch to 1½ inches. Further, cutting rule 14 should not have a position 38 on base member 12 wherein position 38 results in any portion of cutting rule 14 closer than about ¼ inch from first end 22, second end 24, left side 26 or right side 28 of base member 12. This distance prevents biasing of the sheet material being cut using die cut assembly 10 and the roller die cutting machine.

FIGS. 1 and 3 illustrate a compressible top layer 16 that is generally rectangular in shape and includes a top face 42, a bottom face 44, a length 46, a width 48 and a thickness 50. In general, length 46 and width 48 of compressible top layer 16 are similar to that of base member 12. Bottom face 44 of compressible top layer 16 is generally coupled to top face 18 of base member 12. One coupling method is the use of an adhesive; however, a person ordinarily skilled in the art would recognize alternative coupling methods that may be utilized within die cut assembly 10. Further, compressible top layer 16 is generally an elastic material that subsequently returns to its original shape after being compressed. Elastic materials that may be utilized in die assembly 10 include but are not limited to rubber, neoprene, compressible foam, and sponge. In general, cutting rule 14 nests within compressible top layer 16. Further, thickness 50 of compressible top layer 16 is such that the top face 42 of compressible top layer 16 extends beyond cutting edge 34 of cutting rule 14 in a direction away from top face 18 of base member 12. This relative positioning allows for cutting edge 12 to be hidden and protected in an inactive position and also protects users from contacting cutting edge 12 during handling and transport; yet, when compressible top layer 16 is compressed, the cutting edge 34 is exposed and comes into operable contact with sheet material. Generally, thickness 50 of compressible top layer 16 is around ⅛-⅜ inches, but the person of ordinary skill in the art will recognize that alternative thicknesses may be required due to the sheet material being cut.

FIGS. 2 and 3 illustrate one embodiment of die cut assembly 10 wherein pattern 36 is etched by machine or laser through base member 12 creating slits 41 through base member 12 that match pattern 36 of cutting rule 14. Alternatively, slits 41 may be realized using a saw. The slits 41 generally match the blade width 35 of cutting rule 14 and cutting rule 14 may be joined to base member 12 by being inserted and secured within the slits 41 i.e. by staking or other means. The slits 41 and cutting rule 14 may be fabricated complimentarily to ensure cutting rule 14 will not extend past bottom face 20 of base member 12 when cutting rule 14 is inserted into base member 12. Compressible top layer 16 is then coupled to top face 18 of base member 12 using adhesive. An alternative embodiment includes cutting rule 14 formed to pattern 36 wherein pattern 36 includes attachment tabs (not shown) whereby attachment tabs (not shown) are coupled to base member 12 by a fastener. The aforementioned embodiments only present a few embodiments of die cut assembly 10 and a person of ordinary skill in the art will recognize additional methods for coupling cutting rule 14 and compressible top layer 16 to said base member 12.

Figure 6:
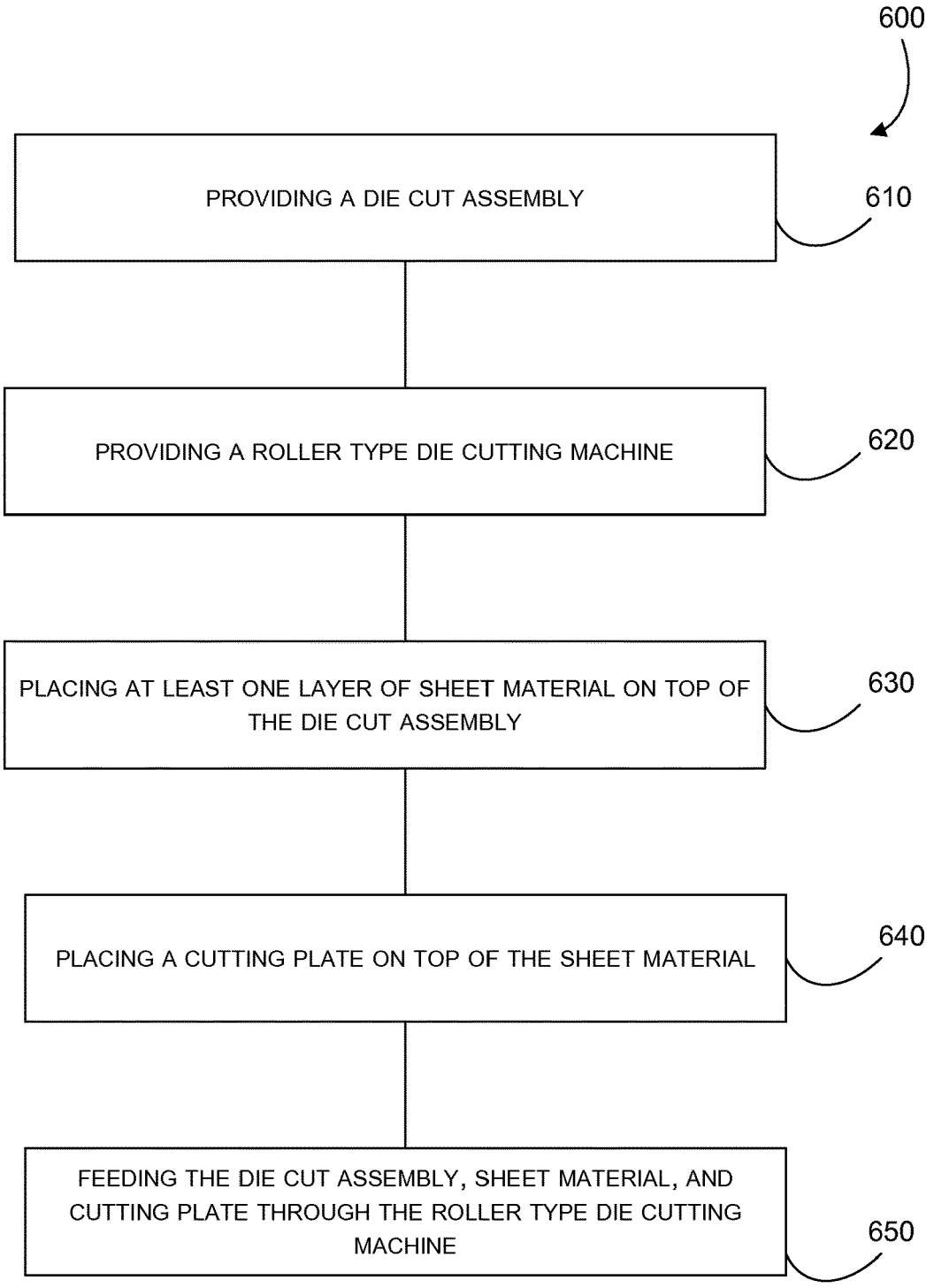
FIG. 6 is a schematic drawing of an exemplary method according to an embodiment of the present invention.

With reference now to FIG. 6, an exemplary method for cutting multiple shapes from sheet material 600 will now be discussed. As shown in FIG. 6, an exemplary method for use in accordance with the present invention may preferably include the steps of: providing a die cut assembly 610 as discussed above in FIGS. 1-5; providing a roller type die cutting machine 620; placing at least one layer of sheet material on top of the die cut assembly 630; placing a cutting plate on top of the sheet material 640; and feeding the die cut assembly 650, sheet material, and cutting plate through the roller type die cutting machine.

Die cut assembly 10 is generally utilized in a roller die cutting machine (not shown). Generally, die cut assembly 10 is placed on a work surface of roller die cutting machine wherein top face 42 of compressible top layer 16 faces upward. Sheet material (not shown) rests on top face 42 of compressible top layer 16. A cutting plate (not shown), such as one made from plexiglass is placed on top of the sheet material so that the sheet material is between die cut assembly 10 and the cutting plate. A stacked assembly including die cut assembly 10, sheet material and cutting plate is fed through a roller die cutting machine. Compressible top layer 16 is compressed by the rollers, exposing cutting edge 34 of cutting rule 14. The compression roller compresses die cut assembly 10, sheet material, and cutting plate whereby sheet material is sheared as cutting plate is forced by compression into operable contact with cutting edge 34. The cut shapes are then removed from the assembly and the cut shapes are ready for use in quilts, scrap books, or other project applications. Die cut assembly 10 is generally to be used with a roller die cutting machine, but a person skilled in the art will recognize that there are other compression methods that could obtain an equivalent result using die cut assembly 10 including, but not limited to, press die cutting machines.

It should be noted that while time such as top, bottom, left, and right are used in this specification and appended claims, such base terms are used to provide relative positions of the various components. Such positional terms should not be read as limiting the orientation of the die cut in a three-dimensional space. For example, in some alternative embodiments, the die cut may be inverted such that the base member 12 is on top of the layer 16 when die cut assembly is in use.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A die cutting assembly for use with a die cutting machine, wherein said die cutting assembly comprises:

a first base member including a top face, a bottom face, a top end, a bottom end, a left side, and a right side;

a cutting rule including a cutting edge coupled to said first base member; and a compressible layer including a first face and second face wherein said second face of said compressible layer is coupled to said first face of said base member;

wherein said cutting rule is formed in a pattern including a plurality of geometric cutting elements;

wherein the plurality of cutting elements comprises at least a first cutting element and a second cutting element;

wherein said first cutting element is comprised of a first edge, a second edge, third edge, a fourth edge and fifth edge; wherein said first and second edges are orthogonal to each other; wherein the third edge is the longest edge of the first cutting element; wherein the fourth cutting edge is connected between the first edge and the third edge; wherein the wherein fifth edge is connected between the third edge and the second edge, wherein the fourth and fifth edges are of equal size; further wherein the fourth edge is aligned orthogonal to the fifth edge and orthogonal to at least one of the first and second edges;

wherein said second cutting element is comprised of a sixth edge, a seventh edge, eighth edge, a ninth edge and tenth edge; wherein said sixth and seventh edges are aligned orthogonally to each other; wherein the eighth edge is the longest edge of the second cutting element; wherein the ninth cutting edge is connected between the sixth edge and the eighth edge; wherein the tenth edge is connected between the eighth edge and the seventh edge, wherein the ninth and tenth edges are of equal size; further wherein the ninth edge is aligned orthogonal to the tenth edge and orthogonal to at least one of the sixth or seventh edges;

wherein a portion of the third edge in the first cutting element and a portion of the eighth edge in the second cutting element share a common cutting rule;

wherein the eighth edge extends beyond the point of intersection between the fifth edge and the third edge;

wherein the third edge extends beyond the point of intersection between the ninth edge and the eighth edge;

wherein the second edge, fourth edge, sixth edge, and tenth edge are each oriented at an angle which is offset from the angle of the left side of the first base member; wherein the angle of offset is within the range of 3°-10°.

* * * * *